United States Patent [19]

Kos

[11] Patent Number: 4,512,804

[45] Date of Patent: Apr. 23, 1985

[54] WORK-HARDENABLE AUSTENITIC MANGANESE STEEL AND METHOD FOR THE PRODUCTION THEREOF

[75] Inventor: Bernd Kos, Leoben, Austria

[73] Assignee: Vereinigte Edelstahlwerke Aktiengesellschaft (VEW), Vienna, Austria

[21] Appl. No.: 480,998

[22] Filed: Mar. 30, 1983

[30] Foreign Application Priority Data

Apr. 13, 1982 [AT] Austria ..... 1435/82

[51] Int. Cl.[3] ..... C22C 38/38

[52] U.S. Cl. ..... 75/123 N; 75/124; 75/126 B; 75/128 A; 75/129; 75/130 R; 148/137; 148/38

[58] Field of Search ..... 75/123 N, 124 B, 124 C, 75/126 B, 128 A, 130 R, 129; 148/137, 3, 38

[56] References Cited

U.S. PATENT DOCUMENTS 3,113,861 12/1963 Norman ..... 148/137
4,302,248 11/1981 Kasamatsu et al. ..... 75/128 A

FOREIGN PATENT DOCUMENTS 0141842 5/1980 Fed. Rep. of Germany ..... 148/137
53-53513 5/1978 Japan ..... 75/126 B
0322399 2/1972 U.S.S.R. ..... 75/123 N
0581165 12/1977 U.S.S.R. ..... 75/126 B

*Primary Examiner*—L. Dewayne Rutledge
*Assistant Examiner*—Debbie Yee
*Attorney, Agent, or Firm*—Werner W. Kleeman

[57] ABSTRACT

A work-hardenable austenitic manganese steel has a base composition (each in percent by weight) of 0.7 to 1.7 carbon, 5.0 to 18.0 manganese, 0 to 3.0 chromium, 0 to 4.0 nickel, 0 to 2.5 molybdenum, 0.1 to 0.9 silicon, up to 0.1 phosphorus and contains micro-alloying elements of 0.0 to 0.05 titanium, 0.0 to 0.05 zirconium and 0.0 to 0.05 vanadium; the remainder being iron and impurities arising from the melting process. The ratio of carbon to manganese is in the range of 1:4 to 1:14 and the total amount of micro-alloying elements is limited to a range of 0.002 to 0.05 percent by weight. The melt of the base composition is tapped at 1,450° C. to 1,600° C. into a casting ladle in which the micro-alloying elements are added. An ingot is cast, cooled, reheated to austenitization temperatures and quenched.

16 Claims, No Drawings

WORK-HARDENABLE AUSTENITIC MANGANESE STEEL AND METHOD FOR THE PRODUCTION THEREOF

BACKGROUND OF THE INVENTION

The present invention relates to a work-hardenable austenitic manganese (Hadfield type) steel having an elongation at rupture of 10 percent to 80 percent, and to a method for the production thereof.

Work-hardenable austenitic manganese steels have a wide range of application in the form of castings, forgings and rolled material. This wide use is due, in particular, to its high inherent ductility and satisfactory work-hardening ability. Uses range from castings for crushing hard materials to shell-proof objects. The valuable properties of manganese steel reside in the combination of the above-mentioned properties of work-hardening and ductility. Work-hardening takes place whenever manganese steel is subjected to mechanical stress, for example, by shock or impact which converts the austenite in the surface layer partly to an epsilon-martensite. Measurements of work-hardening reveal an increase of between 200 and 550 in Brinell hardness. Thus, castings, forgings and the like increase in hardness during use, if they are subjected to mechanical stress. However, since such objects are also subjected to abrasion, the surface layer is constantly being removed, leaving austenite at the surface. This austenite is again converted by renewed mechanical stress. The alloy located below the surface layer is highly ductile, and manganese steels can therefore withstand high mechanical impact stress without any danger of rupture, even in the case of objects having thin walls.

In the case of objects to be made of manganese steel, it is essential that a preliminary mold or ingot-casting be produced in order to predetermine the properties of objects made therefrom. If the casting has an unduly coarse structure, the object will have low ductility. In the cases of large castings, it is known that grain-size varies over the cross-section. At the outside is a thin, relatively fine-grained edge zone, followed by a zone consisting of coarse columnar crystals, followed, in turn, by the globulitic structure at the center of the casting. Although the steel is essentially austenitic and work-hardenable over its entire cross-section, great differences arise in its mechanical properties, especially in its ductility, as a result of these structural differences.

In order to achieve the most uniform ductility possible over the entire cross-section, it has already been proposed that the casting temperature be kept as low as possible, for example, at 1410° C., since increasing super-cooling should cause the number of nuclei to grow and produce a finer grain-size. These low casting temperatures, however, cause major production problems. For instance, cold-shuts occur in the casting and the rheological properties of the molten metal are such that the mold is no longer accurately filled, especially at the edges. Futhermore, the molten metal solidifies, during casting, on the lining of the ladle, leading to ladle skulls or skins which must be removed and reprocessed. During actual casting, the plug may stick in the outlet, which means that pouring must be interrupted. It will easily be gathered from the foregoing that the economic disadvantages to be incurred for a non-reproducible refining of the grain are so serious that this low-temperature-casting process has not been able to gain acceptance.

Another method of refining the grain involves a specific heat-treatment, the casting being annealed for 8 to 12 hours at a temperature of between 500° C. and 600° C., whereby a large proportion of the austenite is converted into pearlite. This is followed by austenitizing-annealing at a temperature of between 970° C. and 1110° C. This double structural change is supposed to produce a finer grain, but it also causes the product to become extremely brittle during the heat-treatment, so that it ruptures without any deformation even under low mechanical stress. Another major disadvantage is that the process requires a considerable amount of energy.

For these reasons, attempts have already been made to achieve grain refining by adding further alloying elements, for example chromiun, titanium, zirconium and nitrogen, in amounts of at least 0.1 percent or 0.2 percent by weight. Although at low casting temperatures, these additions or additives do refine the grain, they substantially impair mechanical properties, especially elongation and notch-impact strength.

Manganese steels (Hadfield type) usually have a carbon content of 0.7 percent to 1.7 percent by weight, with a manganese content of between 5 percent by weight and 18 percent by weight. A carbon:manganese ratio of between 1:4 and 1:14 is also essential if the properties of manganese steels are to be maintained. At lower ratios, austenitic steel is no longer present, the steel can no longer be work-hardened, and toughness is also impaired. At higher ratios, the austenite is too stable, again there is no work-hardening, and the desired properties are also not obtained.

A phosphorus content in excess of 0.1 percent by weight produces an extreme decline in toughness, so that, as is known, a particularly low phosphorus content must be sought.

ASTM A 128/64 describes four different kinds of manganese steel, with the carbon content varying between 0.7 percent by weight and 1.45 percent by weight and the manganese content between 11 percent by weight and 14 percent by weight. The carbon content is varied to alter the degree of work-hardening, and this may also be influenced by the addition of chromium in amounts of between 1.5 percent by weight and 2.5 percent by weight. Coarse carbide precipitations are to be avoided by adding up to 2.5 percent by weight of molybdenum. An addition of up to 4.0 percent by weight of nickel is intended to stabilize the austenite, thus preventing the formation of pearlite in thick-walled castings.

Also known is manganese steel containing about 5 percent by weight of manganese. Although such steels have little toughness, they have high resistance to wear.

OBJECTS OF THE INVENTION

It is an important object of the present invention to provide a work-hardenable austenitic manganese steel having an elongation at rupture of 10 percent to 80 percent, the most uniform possible structure over the entire cross-section, and a particularly fine grain size, with no impairment of mechanical properties.

DETAILED DESCRIPTION OF THE INVENTION

The work-hardenable austenitic manganese steel according to the invention, having an elongation at rupture of 10 percent to 80 percent, measured according to L=5 d or L=10 d, and the following content in percent by weight:

0.7 to 1.7 C
5.0 to 18.0 Mn
0 to 3.0 Cr
0 to 4.0 Ni
0 to 2.5 Mo
0.1 to 0.9 Si
up to 0.1 P and with the proviso that the carbon:manganese ratio be between 1:4 and 1:14, comprises, as micro-alloying elements, up to 0.05 percent of titanium, 0.05 percent of zirconium and 0.05 percent of vanadium, with the proviso that the sum of micro-alloying elements be between 0.002 percent and 0.05 percent by weight.

It came as a complete surprise to find that such small additions of alloying elements refine the grain and simultaneously maintain or increase mechanical properties, since additions of 0.01 percent by weight or more result in impairment of the aforesaid mechanical properties. No precise explanation for this has as yet been found. Zirconium and vanadium are particularly effective at high casting temperatures. The vanadium may be advantageously present in a range of 0.01 percent by weight to 0.05 percent by weight.

A still finer grain-size is obtained by also adding 0.002 percent by weight to 0.008 percent by weight of boron to the manganese steel.

Particularly satisfactory grain refinement is obtained by using only 0.01 percent by weight to 0.025 percent by weight of titanium as a micro-alloying element.

If the manganese steel contains from 0.01 percent by weight to 0.05 percent by weight of aluminum, the titanium content can be particularly accurately maintained.

The production of a manganese-steel casting according to the invention, by melting a charge in an electric furnace and adding to the molten metal lime-containing and slag-forming additives, adjusting to the desired analysis, raising the charge to a tapping temperature of 1450° C. to 1600° C., deoxidizing with an element having an affinity for oxygen, and tapping into the casting ladle, consists mainly in that the content of the micro-alloying elements titanium, zirconium and vanadium is adjusted in the casting ladle, the melt being poured at a temperature of between 1420° C. and 1520° C., the casting being cooled down and then heated again to an austenitizing temperature of 980° C. to 1150°, and being then quenched.

Adding the micro-alloying elements in the ladle ensures that the content of the said elements is reproducible. A particular high degree of toughness is obtained by heating the casting to an austenitizing temperature of 980° C. to 1150° C., followed by quenching.

If after being heated to 1030° C. to 1150° C., the casting is cooled to a temperature of 980° C. to 1000° C. and is quenched after the temperature in the casting has equalized, this substantially reduces the tendency of the casting to crack. Manganese steel has lower heat-conductivity than other steels (only one sixth that of iron), and particular attention must therefore be paid to temperature equalization.

Even in the case of large cross-sections, reliable dissolution of grain-boundary carbides may be achieved, with low power-consumption, by a solution heat-treatment at a temperature of between 1080° C. and 1100° C., after which the temperature is lowered to 980° C. to 1000° C. and is equalized. The casting is then quenched.

A casting having particular low internal stress may be obtained by heating it to the austenitizing temperature and then subjecting it alternatingly to coolants of different heat-conductivity. Particularly suitable coolants for this purpose are water and air.

If a casting is removed from the mold at a temperature of between 800° C. and 1000° C., is then placed in a heat-treatment furnace in which the temperature of the casting is equalized, and then is immediately raised to the austenitizing temperature, this provides a particularly energy-saving process and at the same time prevents high stresses from building up in the casting and avoids pearlitizing.

The invention is explained hereinafter in greater detail by reference to the following examples:

EXAMPLE 1

15 t of manganese steel of the following composition were melted in an arc-furnace:

1.21 percent by weight of carbon; 12.3 percent by weight of manganese; 0.47 percent by weight of silicon; 0.023 percent by weight of phosphorus; 0.45 percent by weight of chromium, and traces of nickel and molybdenum. The melt was covered with a slag consisting of 90 percent by weight of limestone and 10 percent by weight of calcium fluoride, after which the melt was adjusted to a tapping temperature of 1520° C. Final deoxidizing was then carried out with metallic aluminum. After deoxidizing, the melt was tapped into the casting ladle, where the measured temperature was 1460° C. The melt was poured into a basic sand casting mold (magnesite). The casting obtained was a tumbler having a gross weight of 14 t and a net weight of 11 t had walls between 60 mm and 180 mm in thickness. The casting was allowed to cool to room temperature, was removed from the mold, and then was heated slowly to 1050° C. After a holding period of four hours, the tumbler was quenched in water. The casting thus obtained exhibited cracks which had to be closed by welding with the same type of material. The metallographic tests showed an extreme transcrystallite zone with an adjacent globulitic zone. Test pieces from the said globulitic zone showed 8.4 percent elongation, as measured according to L=10 d. Tensile strength was 623N/mm$^2$.

EXAMPLE 2

The procedure was the same as in Example 1, titanium in the form of ferro-titanium being added in the casting ladle. The casting ladle was moved to the mold and pouring was carried out at 1460° C. The casting was cooled and then heated to 1100° C., being held at this temperature for four hours. The temperature of the furnace was then lowered to 1000° C. Temperature-equalization was obtained in the casting after one hour, after which the casting was cooled by alternating immersion in a bath of water. The tumbler thus obtained was free from cracks. Metallographic investigation revealed a completely uniform fine-grained structure, except at the edge zone which was microcrystalline. The average titanium-content of the casting was 0.02 percent by weight. Samples taken from the center and edge of the casting showed almost identical mechanical properties, the tensile strength being 820 and 830N/mm$^2$, respectively, and the elongation 40 percent and 43 percent, respectively.

EXAMPLE 3

For the purpose of producing a 180 Kg drop-forged striking hammer, with trunnions, for a rock-crushing mill, an ingot similar to that in Example 2 was cast. This ingot was divided and the parts were converted into striking hammers at a forging temperature of 1050° C. In the vicinity of the trunnions, these hammers exhibited a completely fine structure which was maintained even after solution heat-treatment and quenching. A hammer produced with the alloy according to Example 1 showed coarse-grained crystals in the vicinity of the trunnions, resulting in some micro-cracks.

EXAMPLE 4

10 t of manganese steel of the following composition were melted in an arc-furnace:

1.0 percent by weight of carbon; 5.2 percent by weight of manganese; 0.4 percent by weight of silicon; 1.7 percent by weight of chromium; 1.0 percent by weight of molybdenum, and 0.03 percent by weight of phosphorus. The melt was covered with a slag consisting of 90 percent by weight of limestone and 10 percent by weight of calcium fluoride, and the melt was adjusted to a tapping temperature of 1490° C. Final deoxidizing was then carried out with metallic aluminum. After deoxidizing, the melt was tapped into the casting ladle where the measured temperature was 1430° C. Ferro-titanium and a zircon-vanadium alloy were added to the melt in the casting ladle. During the casting of plates for ball-mills, a temperature of 1430° C. was maintained. The plates obtained had walls 80 mm in thickness. They were removed from the mold at a temperature of 850° C. and were held for two hours in a heat-treatment furnace adjusted to a temperature of 850° C. until the temperature had equalized. Thereafter, the said plates were heated to 1100° C. and were then cooled. Metallographic investigation revealed a completely uniform fine-grained structure except for the edge-zone, which was microcrystalline. The average content of titanium, vanadium and zirconium was 0.03 percent by weight. The mechanical properties of samples taken from the edges and centers were almost identical, the tensile strength being 850 and 835N/mm$^2$, respectively, and the elongation 45 percent and 48 percent, respectively.

EXAMPLE 5

The procedure was as in Example 2, but boron as well as titanium were added in the casting ladle. The temperature pattern was as in Example 2. The casting had an average titanium content of 0.02 percent by weight and an average boron content of 0.005 percent by weight. In the case of samples taken from similar locations, micrographs showed 50 grains in the samples containing titanium only and an average of 60 grains in samples also containing boron, the reduction in average grain-size being from 0.02 mm to 0.017 mm.

EXAMPLE 6

500 kg of manganese steel of the following composition were melted in an induction furnace:

1.35 percent by weight of carbon; 17.2 percent by weight of manganese; traces of nickel and chromium, and 0.02 percent by weight of phosphorus. The melt was covered with a slag consisting of 90 percent by weight of limestone and 10 percent by weight of calcium fluoride and was adjusted to a tapping temperature of 1600° C. Final deoxidizing was carried out with metallic aluminum, after which the melt was tapped into the casting ladle and titanium was added. Round bars 110 mm in diameter were then cast at 1520° C. Upon cooling, the bars were removed from the molds, were heated to 1030° C., and were held at this temperature for five hours. The furnace-temperature was then lowered to 980° C., at which it was held for an hour and a half. The bars were then quenched in a bath of water.

The melts were repeated with varying titanium contents, the mechanical values given in the following table being measured on test-pieces taken from the centers and edge-zones:

| | center test-pieces | | edge test-pieces | |
|---|---|---|---|---|
| % by weight of titanium | tensile strength N/mm$^2$ | elongation at rupture % | tensile strength N/mm$^2$ | elongation at rupture % |
| — | 650 | 12 | 710 | 22 |
| 0.2 | 550 | 7.8 | 710 | 22 |
| 0.1 | 580 | 9.2 | 705 | 21 |
| 0.04 | 790 | 42 | 810 | 45 |
| 0.02 | 812 | 50 | 825 | 55 |
| 0.01 | 815 | 52 | 830 | 58 |

As may be gathered from the table, the addition of 0.1 percent by weight of titanium produced impairment of mechanical properties and also a relatively large difference between edge and center test-pieces. With a titanium content of less than 0.05 percent by weight, the properties of edge and center test-pieces are almost identical and there is an increase in mechanical properties as compared with non-micro-alloy manganese steel.

Tensile strength and elongation at rupture were determined in accordance with DIN 5 D 145/1975.

While there described present preferred embodiments of the invention, it is to be distinctly understood that the invention is not limited thereto, but may be otherwise variously embodied and practiced within the scope of the following claims. Accordingly,

What I claim is:

1. A work-hardenable austenitic manganese steel having an elongation at rupture of 10 percent to 80 percent, as measured according to L=5 d or L=10 d, and essentially consisting of, each in percent by weight:

0.7 to 1.7 C
5.0 to 18.0 Mn
0 to 3.0 Cr
0 to 4.0 Ni
0 to 2.5 Mo
0.1 to 0.9 Si
up to 0.1 P with the proviso that the carbon-to manganese ratio is between 1:4 and 1:14, and containing an amount of micro-alloying elements in percent by weight:

0.0 to 0.05 Ti
0.0 to 0.05 Zr with the proviso that the sum Ti +Zr is in the range of 0.002 percent by weight to 0.05 percent by weight, the remainder iron and impurities arising during the melting process.

2. The austenitic manganese steel as defined in claim 1, further including:

boron in the range of 0.002 to 0.008 percent by weight.

3. The austenitic manganese steel as defined in claim 1, further including:

aluminum in the range of 0.01 to 0.05 percent by weight.

4. The austenitic manganese steel as defined in claim 1, wherein:

titanium is the only micro-alloying element and is present in the range of 0.01 percent by weight to 0.025 percent by weight.

5. The austenitic manganese steel as defined in claim 1, further including:

vanadium in the range of 0.01 percent by weight to 0.05 percent by weight with the proviso that the sum of Ti+Zr+V is in the range of 0.002 percent by weight to 0.05 percent by weight.

6. A method for producing a work-hardenable austenitic manganese steel casting or ingot, said method comprising the steps of:

melting a charge in an electric furnace to form a melt;

adding lime-containing and slag-forming additives to said melt;

adjusting said melt for an analysis as given below in percent by weight:

0.7 to 1.7 carbon
5.0 to 18.0 manganese
0.0 to 3.0 chromium
0.0 to 4.0 nickel
0.0 to 2.5 molybdenum
0.1 to 0.9 silicon
up to 0.1 phosphorus, the remainder being iron and impurities originating in the melting process and the ratio of carbon to manganese being in the range of 1:4 to 1:14;

heating said melt to a tapping temperature in the range of 1450° C. to 1600° C.;

deoxidizing said melt using an element having an affinity for oxygen;

tapping said melt into a casting ladle;

adding to said melt in said casting ladle micro-alloying elements in an amount as given below in percent by weight:

0.0 to 0.05 titanium
0.0 to 0.05 zirconium the sum of the contents of said micro-alloying elements being in the range of 0.002 to 0.05 percent by weight;

casting said melt at a temperature in the range of 1420° C. to 1600° C. into a mold;

cooling said melt in said mold to form said casting or ingot;

reheating said casting or ingot to an austenitizing temperature in the range of 980° C. to 1150° C.; and quenching said reheated casting or ingot.

7. The method as defined in claim 6, wherein:

said casting or ingot is reheated to a temperature in the range of 1030° C. to 1150° C.

8. The method as defined in claim 7, wherein:

said casting or ingot is reheated to a temperature in the range of 1080° C. to 1100° C.

9. The method as defined in claim 7, further including the steps of:

cooling said reheated casting or ingot to a temperature in the range of 980° C. to 1000° C.; and equalizing said temperature in said casting or ingot.

10. The method as defined in claim 6, wherein:

said casting or ingot is quenched by alternatingly subjecting the same to coolants of different heat conductivities.

11. The method as defined in claim 10, wherein:

said alternatingly used coolants are water and air.

12. The method as defined in claim 6, wherein:

said casting or ingot is cooled in said mold to a temperature in the range of 800° C. to 1000° C.; and said casting or ingot in removed from said mold and placed in a heat-treating furnace to equalize said temperature.

13. The method as defined in claim 6, further including the step of:

additionally adding boron in an amount corresponding to a range of 0.002 to 0.008 percent by weight to said melt in said ladle.

14. The method as defined in claim 6, further including the step of:

adding aluminum to said melt in an amount corresponding to a range of 0.01 to 0.05 percent by weight.

15. The method as defined in claim 6, wherein:

titanium is added to said melt in said ladle in an amount corresponding to a range of 0.01 to 0.025 percent by weight.

16. The method as defined in claim 6, further including the step of:

adding vanadium in an amount corresponding to a range of 0.01 percent by weight to 0.05 percent by weight with the proviso that the sum of Ti+Zr+V is in the range of 0.002 percent by weight to 0.05 percent by weight.

* * * * *

UNITED STATES PATENT AND TRADEMARK OFFICE

CERTIFICATE OF CORRECTION

PATENT NO. : 4,512,804

DATED : April 23, 1985

INVENTOR(S) : BERND KOS

It is certified that error appears in the above—identified patent and that said Letters Patent is hereby corrected as shown below:

Column 8, line 24, after "ingot", please delete "in" and replace it with --is--

Signed and Sealed this

*Seventeenth* Day of *September 1985*

[SEAL]

*Attest:*

*Attesting Officer*

DONALD J. QUIGG

*Commissioner of Patents and Trademarks—Designate*